US009676467B2

(12) United States Patent
Terazawa et al.

(10) Patent No.: US 9,676,467 B2
(45) Date of Patent: Jun. 13, 2017

(54) WATERCRAFT FOR LEISURE USE

(71) Applicant: YANMAR CO., LTD., Osaka-shi, Osaka (JP)

(72) Inventors: Akira Terazawa, Kunisaki (JP); Kouji Kinoshita, Kunisaki (JP); Shinya Shiina, Kunisaki (JP); Kiyoyuki Okuyama, Yamagata (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 14/905,889

(22) PCT Filed: Jul. 17, 2014

(86) PCT No.: PCT/JP2014/069065
§ 371 (c)(1),
(2) Date: Jan. 18, 2016

(87) PCT Pub. No.: WO2015/012196
PCT Pub. Date: Jan. 29, 2015

(65) Prior Publication Data

US 2016/0152313 A1 Jun. 2, 2016

(30) Foreign Application Priority Data

Jul. 24, 2013 (JP) ..... 2013-154039
Dec. 12, 2013 (JP) ..... 2013-257526
(Continued)

(51) Int. Cl.
*B63B 35/73* (2006.01)
*F02B 61/04* (2006.01)
(Continued)

(52) U.S. Cl.
CPC ..... *B63J 2/06* (2013.01); *B63B 17/00* (2013.01); *B63B 17/0027* (2013.01);
(Continued)

(58) Field of Classification Search
CPC ..... B63B 15/00; B63B 2015/00; B63B 17/00; B63B 17/02; B63B 2017/00;
(Continued)

(56) References Cited

U.S. PATENT DOCUMENTS 2,583,929 A * 1/1952 Clark ..... B63B 35/14 114/175
3,465,665 A * 9/1969 O'Day ..... B63J 2/06 454/78
(Continued)

FOREIGN PATENT DOCUMENTS

JP S6422694 A 1/1989
JP H06115486 A 4/1994
(Continued)

OTHER PUBLICATIONS

International Search Report corresponding to Application No. PCT/JP2014/069065; Date of Mailing: Sep. 9, 2014, with English translation.

*Primary Examiner* — Daniel V Venne
(74) *Attorney, Agent, or Firm* — Cantor Colburn LLP

(57) ABSTRACT

An object is to provide a technique related to a small watercraft that can prevent water from entering an inboard section through air intake ports. A small watercraft for leisure use is configured to obtain thrust by driving a propeller with an engine serving as a power source and includes an air intake port configured to introduce air into an engine room in an inboard section from the outside, and a radar arm configured to support a radar. The air intake port is positioned on the inner side with respect to the radar arm.

8 Claims, 37 Drawing Sheets

(30) Foreign Application Priority Data

Dec. 12, 2013 (JP) ..... 2013-257529
Dec. 13, 2013 (JP) ..... 2013-258739

(51) Int. Cl.

| | |
|---|---|
| ***F02M 35/16*** | (2006.01) |
| ***B63B 17/00*** | (2006.01) |
| ***B63J 2/06*** | (2006.01) |
| ***B63B 19/14*** | (2006.01) |
| ***B63B 21/04*** | (2006.01) |
| ***B63B 27/14*** | (2006.01) |
| ***B63J 2/10*** | (2006.01) |
| ***B63H 20/10*** | (2006.01) |
| *B63B 17/02* | (2006.01) |

(52) U.S. Cl.
CPC ..... *B63B 19/14* (2013.01); *B63B 21/045* (2013.01); *B63B 27/146* (2013.01); *B63B 35/73* (2013.01); *B63H 20/10* (2013.01); *B63J 2/10* (2013.01); *B63B 2017/026* (2013.01); *B63B 2027/141* (2013.01)

(58) Field of Classification Search
CPC ..... B63B 2017/02; B63B 2017/026; B63B 2017/04; B63B 2017/045; B63B 2017/054; B63B 2017/063; B63B 19/00; B63B 19/04; B63B 19/08; B63B 2019/00; B63B 2019/08; B63B 27/00; B63B 27/14; B63B 2027/00; B63B 2027/14; B63B 2027/141; B63B 35/00; B63B 35/73; B63B 2035/00; B63B 2035/73; B63B 2201/00; B63B 2704/00; B63B 2710/00; B63J 2/00; B63J 2/06
USPC ..... 440/88 A; 114/362
See application file for complete search history.

(56) References Cited

U.S. PATENT DOCUMENTS

| | | | | |
|---|---|---|---|---|
| 3,982,497 | A | 9/1976 | Caron et al. | |
| 4,742,795 | A * | 5/1988 | DePrey | B63B 27/14 114/343 |
| 5,669,325 | A * | 9/1997 | Feikema | B63B 49/00 114/343 |
| 5,791,952 | A * | 8/1998 | Trinkl | B63J 2/10 114/211 |
| 6,116,180 | A | 9/2000 | Thompson | |
| 8,025,194 | B2 * | 9/2011 | Jesewitz | B63B 25/002 114/343 |
| 8,375,880 | B1 | 2/2013 | St. Clair, Jr. et al. | |
| 8,631,754 | B1 * | 1/2014 | Sax, Sr. | B63B 17/00 114/253 |
| 2006/0144314 | A1 * | 7/2006 | Le Bihan | B63B 17/04 114/363 |
| 2006/0191464 | A1 | 8/2006 | Terleski et al. | |
| 2009/0227157 | A1 | 9/2009 | Mochizuki | |
| 2013/0239871 | A1 | 9/2013 | De Basto et al. | |
| 2014/0202372 | A1 | 7/2014 | De Basto et al. | |

FOREIGN PATENT DOCUMENTS

| | | | |
|---|---|---|---|
| JP | 3020710 | U | 2/1996 |
| JP | H09506573 | A | 6/1997 |
| JP | 2009208655 | A | 9/2009 |
| WO | 2013036940 | A1 | 3/2013 |

* cited by examiner

WATERCRAFT FOR LEISURE USE

CROSS REFERENCE TO RELATED APPLICATIONS

This is the U.S. national stage of application No. PCT/JP2014/069065, filed on Jul. 17, 2014. Priority under 35 U.S.C. §119(a) and 35 U.S.C. §365(b) is claimed from Japanese Application No. 2013-154039, filed Jul. 24, 2013; Japanese Application No. 2013-257526, filed Dec. 12, 2013; Japanese Application No. 2013-257529, filed Dec. 12, 2013; and Japanese Application No. 2013-258739, filed Dec. 13, 2013, the disclosures of which are also incorporated herein by reference.

TECHNICAL FIELD

The present invention relates to a technique for a small watercraft.

BACKGROUND ART

Various conventional techniques related to small watercrafts have been known.

The small watercrafts include a small watercraft for leisure use that is used for sports, recreations, and the like (see Patent Literature 1).

For example, a small watercraft is mainly made of an FRP (Fiber Reinforced Plastics) material, and has an overall length of approximately 12 m, a weight of approximately 10 tons, and a complement of 12 persons.

Some small watercrafts are configured to obtain thrust by driving a propeller with an engine serving as a power source, and to introduce intake air for the engine into an engine room in an inboard section from the outside through air intake ports.

CITATION LIST

Patent Literature

PTL 1: Japanese Unexamined Patent Application Publication No. H6-115486

SUMMARY OF INVENTION

Technical Problem

In the small watercraft, water may splash on air intake ports.

The small watercraft has a problem in that water splashing on the air intake ports enters an inboard section through the air intake ports.

The present invention is made in view of the situation described above, and an object of the present invention is to provide a technique related to a small watercraft that can prevent water from entering an inboard section through air intake ports.

Solution to Problem

A problem to be solved by the present invention is as described above, and means for solving the problem will now be described.

A small watercraft for leisure use configured to obtain thrust by driving a propeller with an engine serving as a power source, and includes an air intake port configured to introduce air into an engine room in an inboard section from outside, and a radar arm configured to support a radar. The air intake port is positioned on the inner side with respect to the radar arm.

According to the present invention, the air intake port opens toward a bow side.

According to the present invention, the small watercraft also includes a guide groove configured to guide the air to the air intake port.

According to the present invention, the guide groove is disposed on a bow side of the air intake port.

According to the present invention, the small watercraft further includes a transom gate, and the transom gate includes an extension portion that extends outward from the transom gate with the transom gate rotated and laid rearward.

Advantageous Effects of Invention

The following effect is obtained as an effect of the present invention. A small watercraft according to the present invention can prevent water from entering an inboard section through air intake ports.

DESCRIPTION OF EMBODIMENTS

Figure 1:
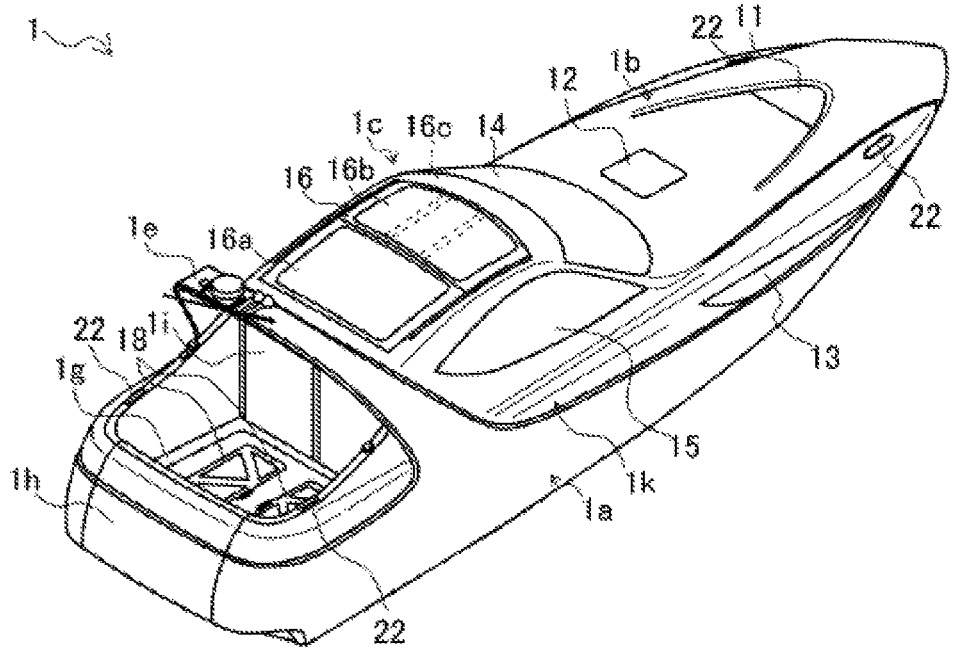
FIG. 1 is a perspective view of a small watercraft according to an embodiment of the present invention.
Figure 2:
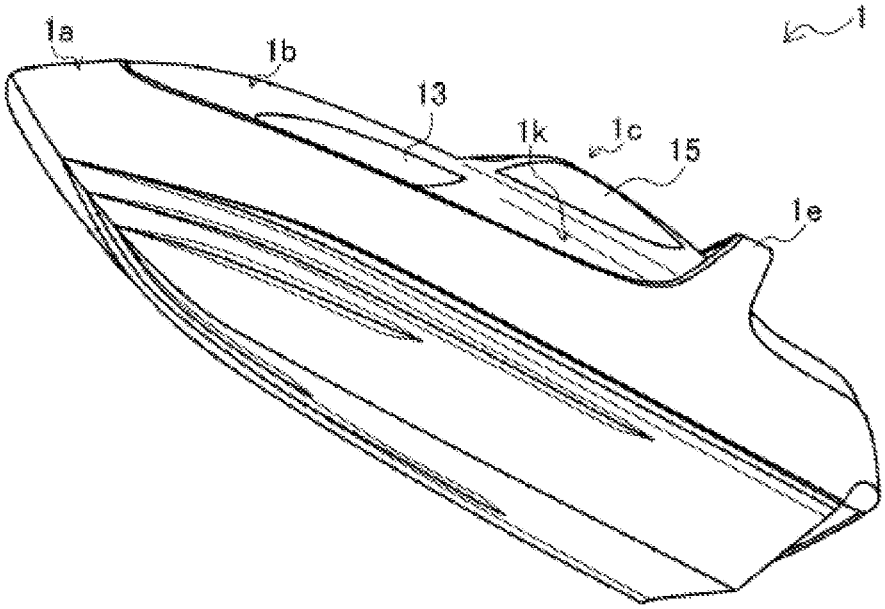
FIG. 2 is a perspective view of the small watercraft.
Figure 3:
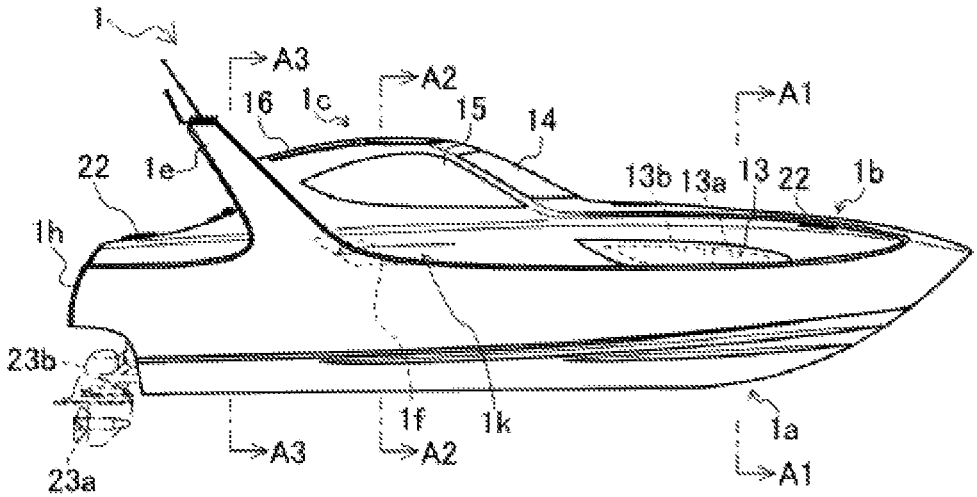
FIG. 3 is a left side view of the small watercraft.
Figure 4:
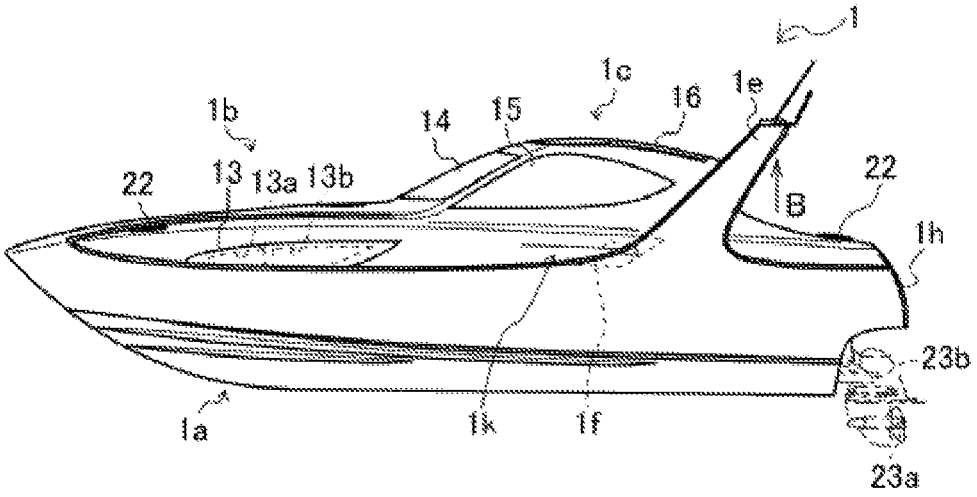
FIG. 4 is a right side view of the small watercraft.
Figure 5:
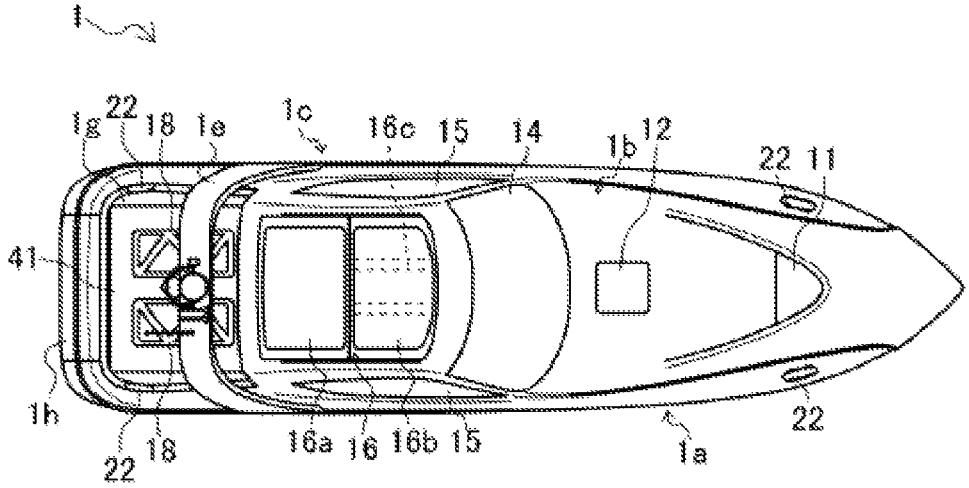
FIG. 5 is a plan view of the small watercraft.
Figure 6:
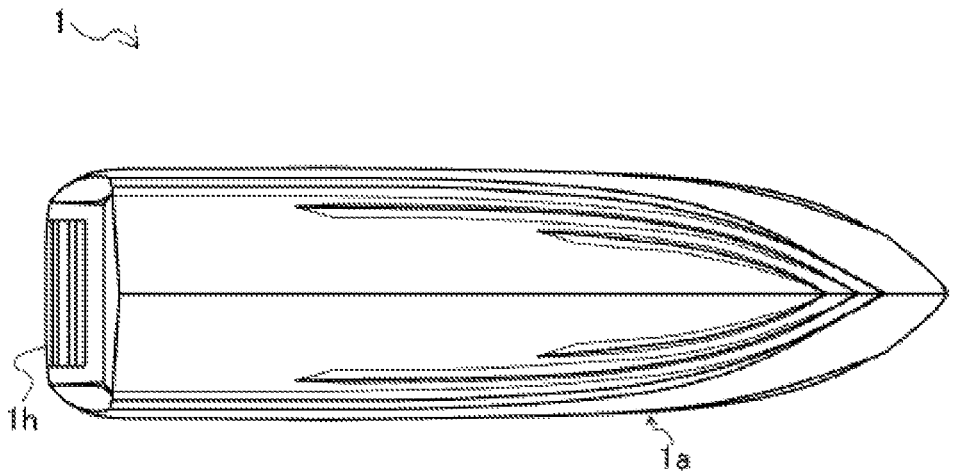
FIG. 6 is a bottom view of the small watercraft.
Figure 7:
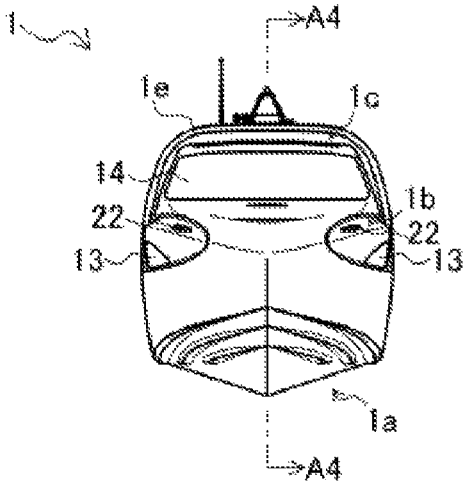
FIG. 7 is a front view of the small watercraft.
Figure 8:
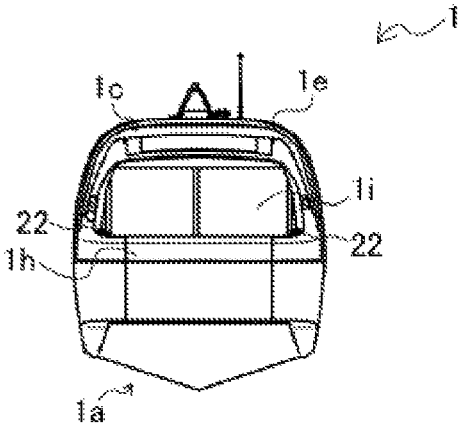
FIG. 8 is a rear view of the small watercraft.
Figure 9:
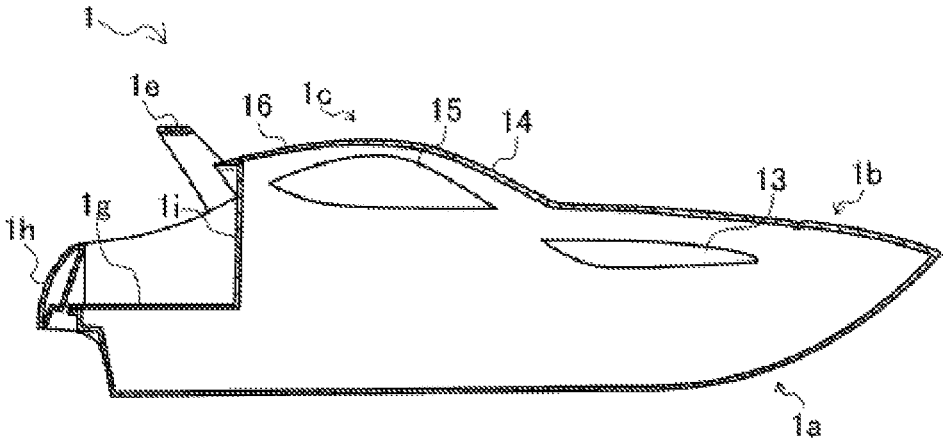
FIG. 9 is a cross-sectional view taken along the line A4-A4 in FIG. 7.
Figure 10:
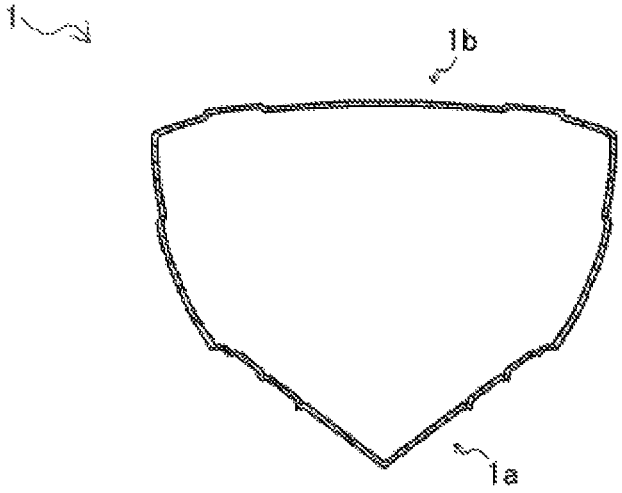
FIG. 10 is an enlarged cross-sectional view taken along the line A1-A1 in FIG. 3.
Figure 11:
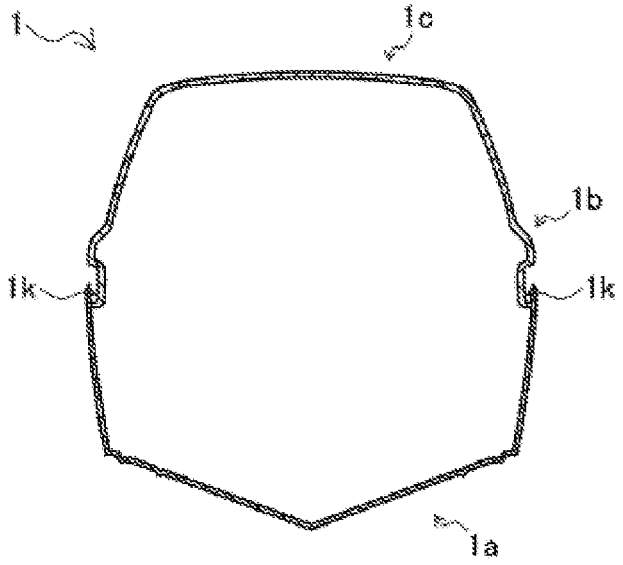
FIG. 11 is an enlarged cross-sectional view taken along the line A2-A2 in FIG. 3.
Figure 12:
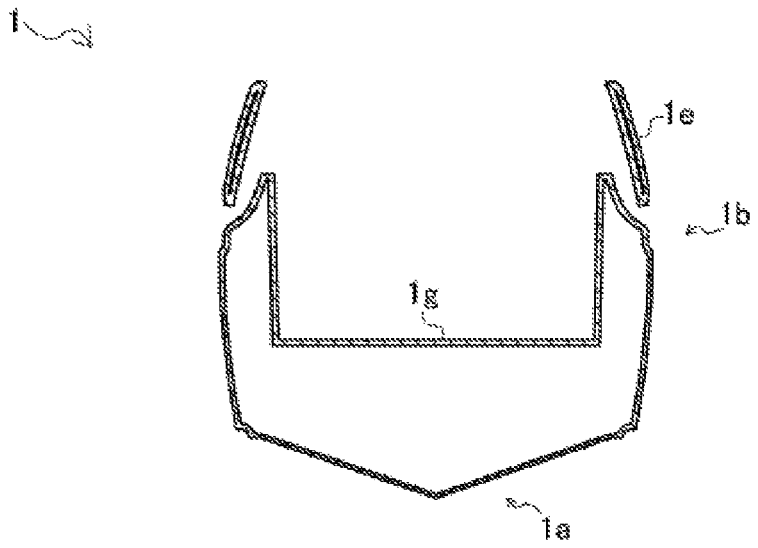
FIG. 12 is an enlarged cross-sectional view taken along the line A3-A3 in FIG. 3.

A small watercraft 1 according to an embodiment of the present invention is described with reference to FIGS. 1 to 37.

As illustrated in FIGS. 1 to 8, the small watercraft 1 is a small watercraft for leisure use, and is used for sports, recreations, and the like. For example, the small watercraft 1 has an overall length of approximately 12 m, a weight of approximately 10 tons, and a complement of 12 persons. The small watercraft 1 includes an engine 23, and is configured to obtain thrust by driving a propeller 23*a* with the engine 23 serving as a power source. On both left and right starboard and port sides of the small watercraft near the propeller 23*a*, a trim tab 23*b* is provided (see FIGS. 28A and 28B). The small watercraft 1 is mainly made of an FRP (Fiber Reinforced Plastics) material. FRP materials are, for example, used for small or large watercrafts and boats, tanks for storing medicines, and water tanks installed on the rooftop of an apartment building, for example. Some FRP materials contain glass fibers and/or polyester fibers.

As illustrated in FIGS. 1 to 13, the small watercraft 1 includes a deck 1*b* on an upper side of a hull 1*a* and a cabin 1*c* on a rear upper side of the deck 1*b*. The small watercraft 1 includes a lounge space and a pilot house 2 that are in the cabin 1*c*. The small watercraft 1 has a width of the deck 1*b* smaller than a width of the hull 1*a*, and side portions of the deck 1*b* positioned on the inner side with respect to side portions of the hull 1*a*. The hull 1*a* and the deck 1*b* of the small watercraft 1 are mainly made of an FRP material. Outer shapes of the hull 1*a* and the deck 1*b* are formed by spraying gelcoat on a mold coated with a release agent (wax), and after the gelcoat is dried (cured), stacking layers of glass fiber roving, unsaturated polyester resin, and the like until a designed thickness is achieved.

Configurations of components of the small watercraft 1 are described in detail below.

The hull 1*a* of the small watercraft 1 is provided with the deck 1*b*, the cabin 1*c*, an engine room 1*d*, a radar arm 1*e*, a pair of left and right air intake ports 1*f*, 1*f*, a rear deck 1*g*, and a transom gate 1*h*.

The deck 1*b* covers an upper part of the hull 1*a* and forms a compartment and the like. The deck 1*b* is provided with a plurality of windows (a front roof window 11, a rear roof window 12, and a pair of left and right side windows 13, 13) for daylighting in the compartment in the inboard section and a mooring device 22.

The small watercraft 1, divided into the bow side and the stern side at the cabin 1*c* (pilot house 2), is relatively longer on the bow side. Thus, the small watercraft 1 can have a space large enough to dispose the front roof window 11 and the rear roof window 12 (a space large enough to dispose two roof windows on the deck 1*b* arranged in the bow and stern direction). Thus, the small watercraft 1 can have the pair of left and right side windows 13 that are large in the bow and stern direction. The pair of left and right side windows 13 each have an inboard section side divided into two sections of a bow side window 13*a* and a stern side window 13*b*. The pair of left and right side windows 13 each have the bow side window 13*a* serving as a window for a main bedroom and the stern side window 13*b* serving as a window for a galley and a salon not illustrated.

Figure 14A:
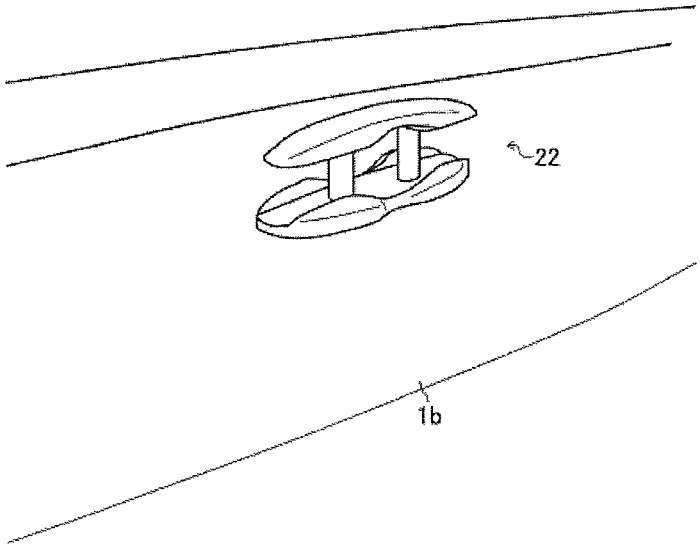
FIG. 14A is a perspective view illustrating a mooring device of the small watercraft.
Figure 14B:
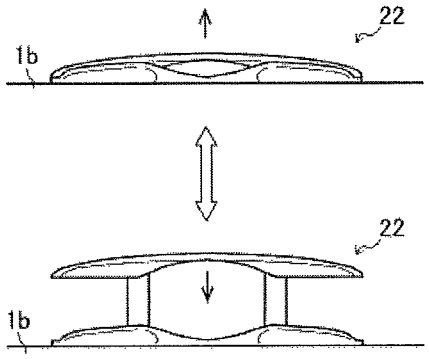
FIG. 14B is a side view illustrating an operating state of the mooring device of the small watercraft.
Figure 15:
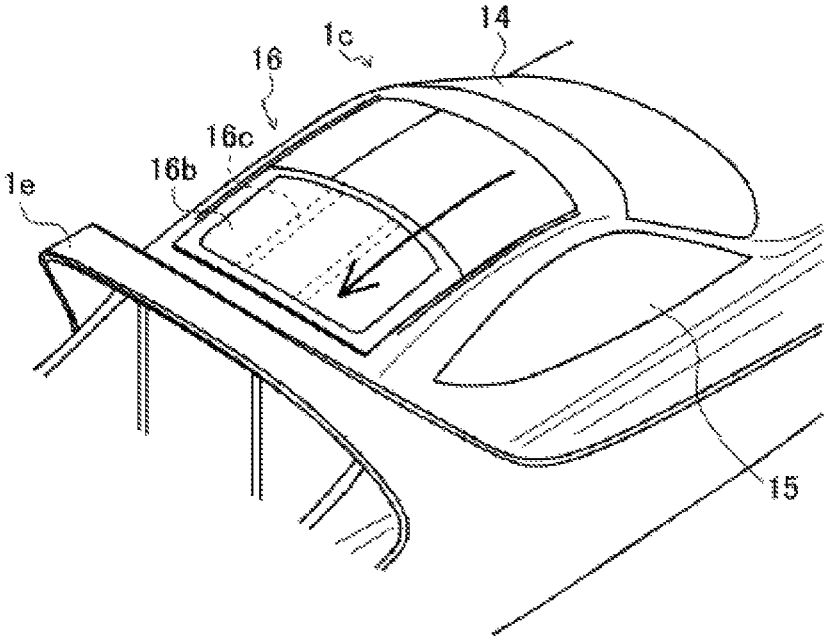
FIG. 15 is an enlarged perspective view illustrating a state where a movable roof of the small watercraft is open.
Figure 16:
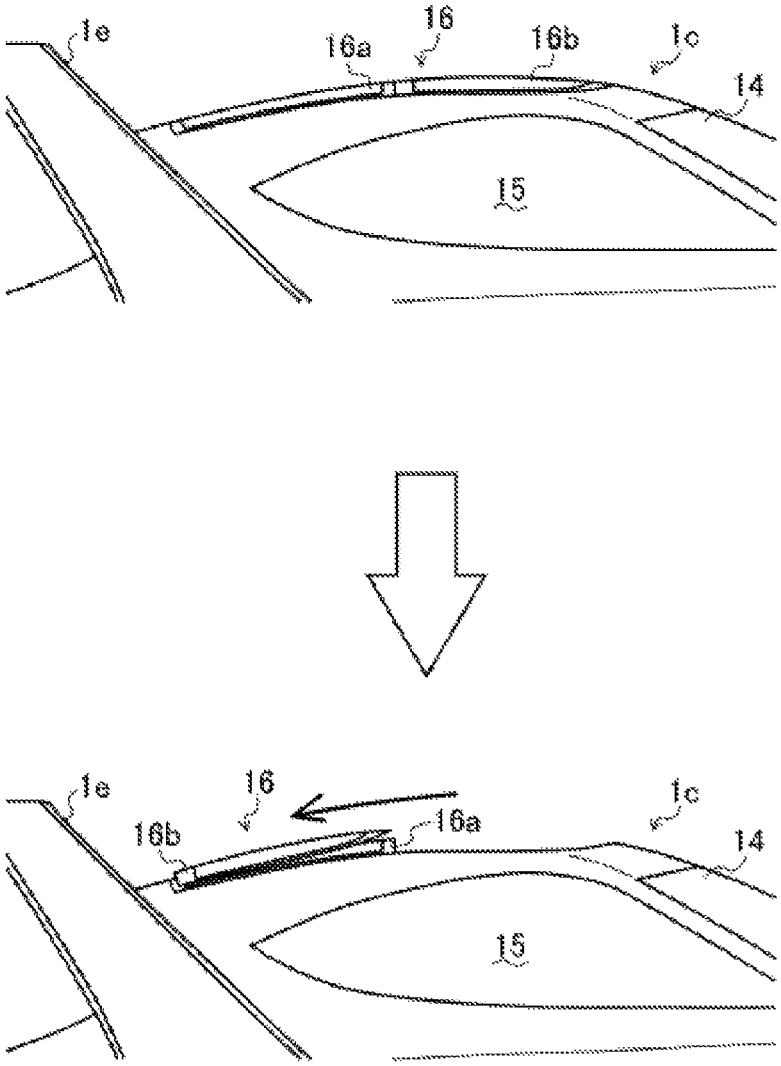
FIG. 16 is a diagram illustrating how a fixed member of the movable roof of the small watercraft moves.
Figure 18:
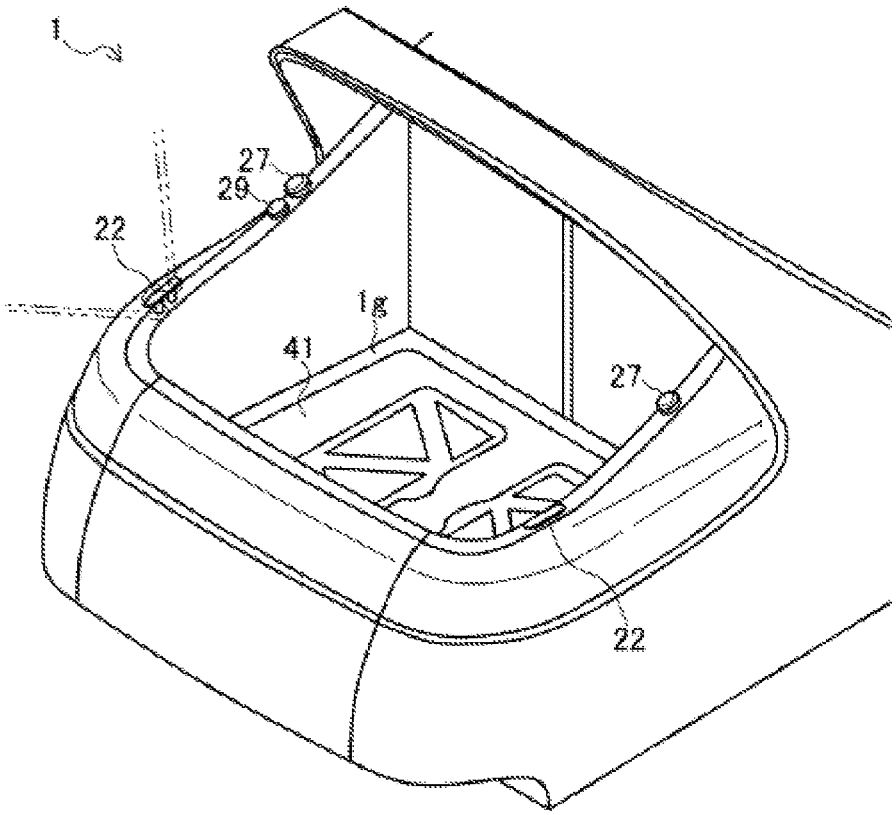
FIG. 18 is a perspective view illustrating fuel supply ports and a daily life water supply port of the small watercraft.

As illustrated in FIGS. 14A-14B and 18, the mooring device 22 is tied with a mooring rope to moor the small watercraft 1 to a pier or the like. The mooring device 22 is provided on each of the port side and the starboard side of the deck 1*b* of the small watercraft 1. The mooring device 22 is provided on each of the port side and the starboard side of a portion defining an enclosure of the rear deck 1*g* in the hull 1*a*.

The mooring device 22 has a bar-like member with an end portion having a protrusion for preventing the tied mooring rope from detaching. The mooring device 22 is configured to be containable in the hull 1*a*. Thus, the mooring device 22 is configured to be contained in the hull 1*a* so as not to protrude from the deck 1*b* during cruising, and is configured to be pulled up from the hull 1*a* so that the mooring rope can be tied during the mooring operation.

As illustrated in FIGS. 1 to 13, the cabin 1*c* protrudes beyond the deck 1*b* to cover the rear side of the deck 1*b*, whereby the pilot house 2 and the lounge space are formed. The cabin 1*c* includes a windshield 14, a pair of left and right side windows 15, 15, and a movable roof 16. The cabin 1*c* has an opening formed in a ceiling portion.

The windshield 14 of the cabin 1*c* is disposed across left and right end portions of the pilot house 2. The windshield 14 has a left and right direction width that is approximately the same as a left and right direction width of the pilot house 2.

Thus, the windshield 14 is disposed across the left and right end portions of the pilot house 2, and the small watercraft 1 features a better view from a helmsman seat 21 in the pilot house 2 compared with a configuration without the windshield 14 disposed across the left and right end portions of the pilot house 2.

As illustrated in FIGS. 1 to 16, the movable roof 16 is provided in the opening formed in the ceiling portion of the cabin 1*c*. The movable roof 16 includes a fixed portion 16*a* and a movable portion 16*b*, and is openable and closable through sliding movement of the movable portion 16*b*. The fixed portion 16*a* and the movable portion 16*b* of the movable roof 16 are each formed by fitting a glass piece on a frame. The movable roof 16 has crosspieces 16*c* formed in the movable portion 16*b* to achieve high glass strength. Thus, the movable portion 16*b* of the movable roof 16 can stably operate.

Figure 17:
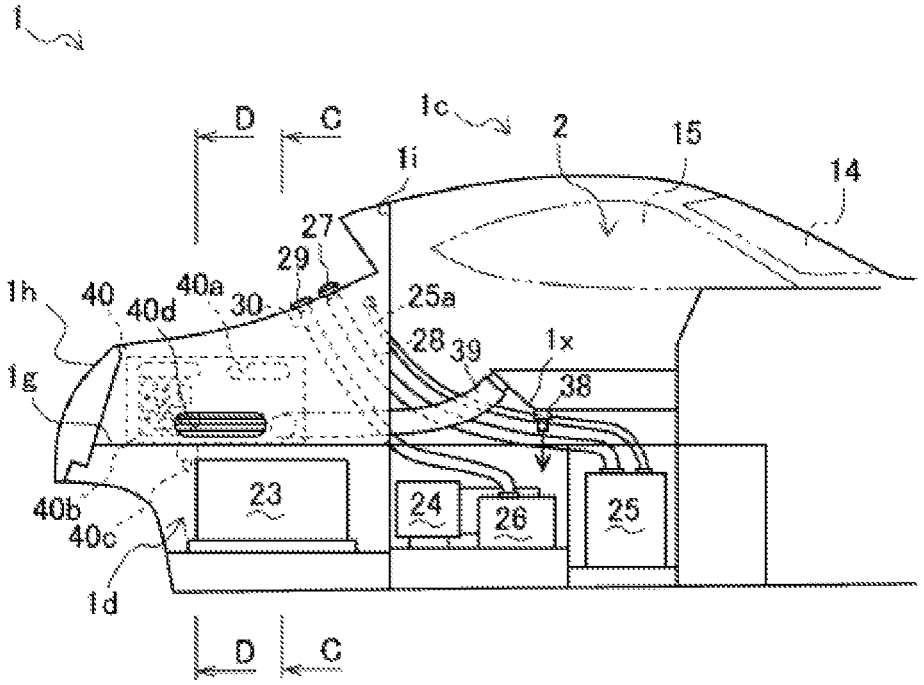
FIG. 17 is a diagram illustrating a configuration of an engine room of the small watercraft.

As illustrated in FIG. 17, an engine 23, a generator 24, and the like are disposed in the engine room 1*d*. The engine room 1*d* is provided in a space (inboard section) surrounded by the hull 1*a* and the deck 1*b* and extending from below the rear side of the cabin 1*c* to below the rear deck 1*g*. Below the cabin 1*c* and in front of the engine room 1*d*, a fuel tank 25 is disposed on the front side and the generator 24 and a daily life water tank 26 are disposed on the rear side. Below the rear deck 1*g* and on the rear side of the engine room 1*d*, the engine 23 is disposed.

The fuel tank 25 stores fuel for the engine 23 or the generator 24. The fuel tank 25 is configured to receive fuel supply from the outside of the small watercraft 1. More specifically, as illustrated in FIG. 18, the small watercraft 1 has fuel supply ports 27 on the starboard and port sides of a portion defining the enclosure of the rear deck 1*g* in the hull 1*a*. As illustrated in FIG. 17, the fuel tank 25 is connected to the left and right fuel supply ports 27 through a fuel supply pipe 28. In other words, the fuel tank 25 is configured to be capable of receiving fuel supply through the left and right fuel supply ports 27. The fuel supply pipe 28 leads to the inside of the engine room 1*d* through the inside of the rear deck 1*g*. The fuel tank 25 is also provided with an air drain pipe 25*a* for communicating the fuel tank 25 to the outside.

The daily life water tank 26 stores daily life water that occupants use. The daily life water tank 26 is configured to be capable of receiving daily life water supply from the outside of the small watercraft 1. More specifically, as illustrated in FIG. 18, the small watercraft 1 has a daily life water supply port 29 on the starboard or port side of the transom of the rear deck 1*g* in the hull 1*a*. As illustrated in FIG. 17, the daily life water tank 26 is connected to the daily life water supply port 29 through a daily life water supply pipe 30. In other words, the daily life water tank 26 is configured to be capable of receiving daily life water supply through the daily life water supply port 29. The daily life water supply pipe 30 leads to the inside of the engine room 1*d* through the inside of a portion defining the enclosure of the rear deck 1*g*.

Figure 19A:
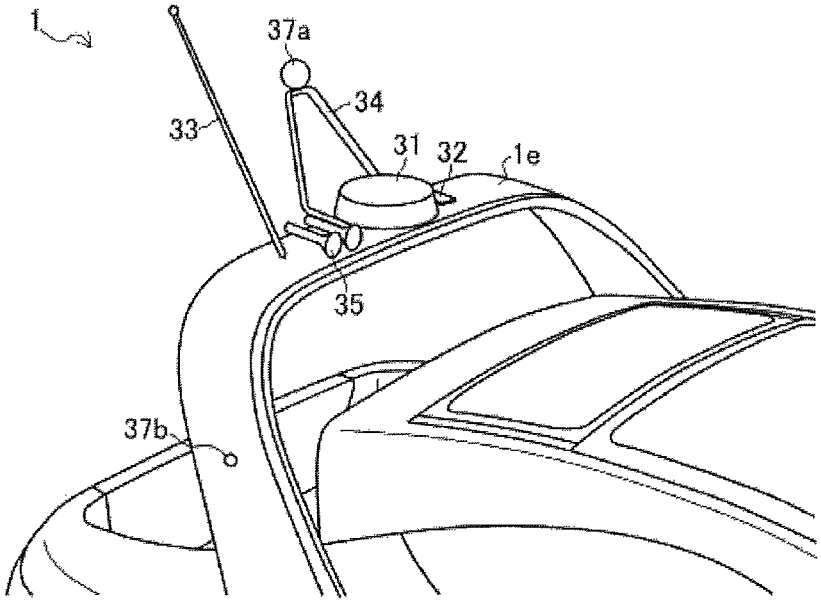
FIG. 19A is a perspective view illustrating various antennae provided to the radar arm of the small watercraft and FIG. 19B is a perspective view in a direction indicated by an arrow B in FIG. 4.
Figure 19B:
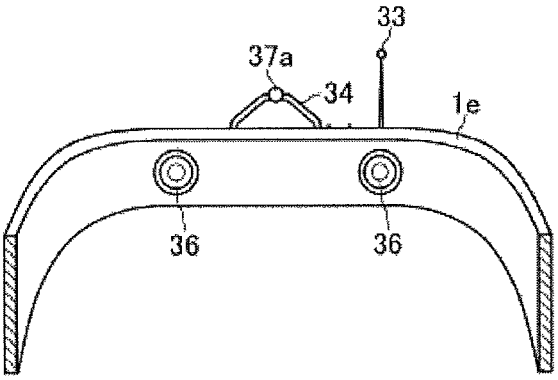

As illustrated in FIGS. 19A and 19B, the radar arm 1*e* is used for supporting a radar antenna 31, a GPS antenna 32, and the like. The radar arm 1*e* is integrally formed with the hull 1*a*. The radar arm 1*e* is formed to have an arch shape. The radar arm 1*e* extends from an upper end from the hull 1*a* in an inclined manner in an upper rear direction, and surrounds side portions of the deck 1*b*, rear side portions of the cabin 1*c*, and a rear upper portion 7 of the cabin 1*c*. The radar arm 1*e* is provided with a radar antenna 31, a GPS antenna 32, a VHF antenna 33, a mast 34, a horn 35, downlights 36, an all-round light 37*a*, and sidelights 37*b*.

The radar antenna 31 is an antenna for a radar, and sends and receives radar waves for detecting other watercrafts, buoys, and other objects on the ocean. The radar antenna 31 is disposed on an upper surface at approximately the center of the radar arm 1*e*. The GPS antenna 32 is an antenna for the GPS (Global Positioning System), and receives signals from GPS satellites. The GPS antenna 32 is disposed on the upper surface of the radar arm 1*e* and on one side of the radar antenna 31. The VHF antenna 33 is an antenna for VHF (ultrashort waves) communications. The VHF antenna 33 is disposed on the upper surface of the radar arm 1*e* and on the other side of the radar antenna 31.

The mast 34 enhances visibility of the all-round light 37*a*. The mast 34 is formed by bending a pipe-like member. The mast 34 is disposed on the upper surface at approximately the center of the radar arm 1*e*. The mast 34 is configured in such a manner that the all-round light 37*a* can be disposed on its top.

The horn 35 is disposed on the upper surface of the radar arm 1*e* and between the radar antenna 31 and the VHF antenna 33.

The downlights 36 illuminate the rear deck 1*g* of the small watercraft 1. The downlights 36 are provided to both left and right on a lower surface of the radar arm 1*e*. The all-round light 37*a* and the sidelights 37*b* notify surrounding watercrafts of the presence of the small watercraft 1. The all-round light 37*a* is disposed on the top of the mast 34. The sidelights 37*b* are disposed on both side surfaces of the radar arm 1*e* (on both starboard and port sides of the small watercraft 1).

A pair of left and right air intake ports 1*f*, 1*f* introduce intake air for the engine 23 into the engine room 1*d* in the inboard section of the small watercraft 1 from the outside. As illustrated in FIGS. 3, 4, and 20 to 25, the air intake ports 1*f* are disposed on both starboard and port sides of the small watercraft 1 and sides of the deck 1*b*. The air intake ports 1*f* are positioned on the upper side of the hull 1*a*.

Figure 20:
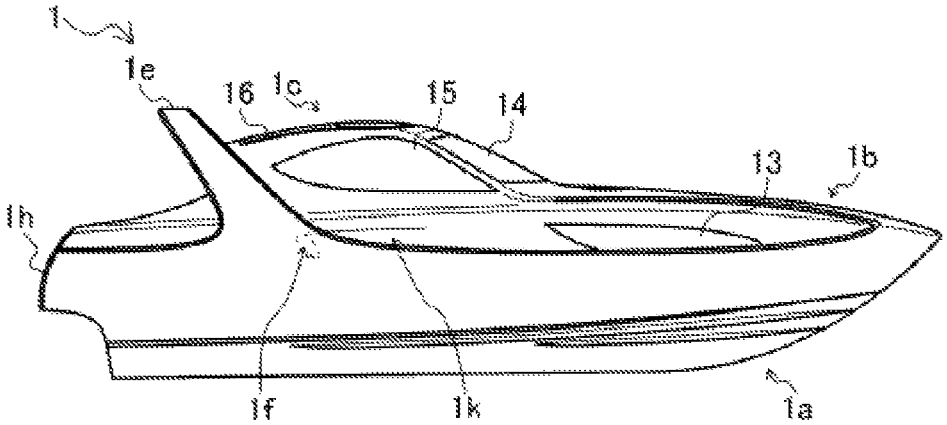
FIG. 20 is a side view illustrating an air intake port of the small watercraft.
Figure 21:
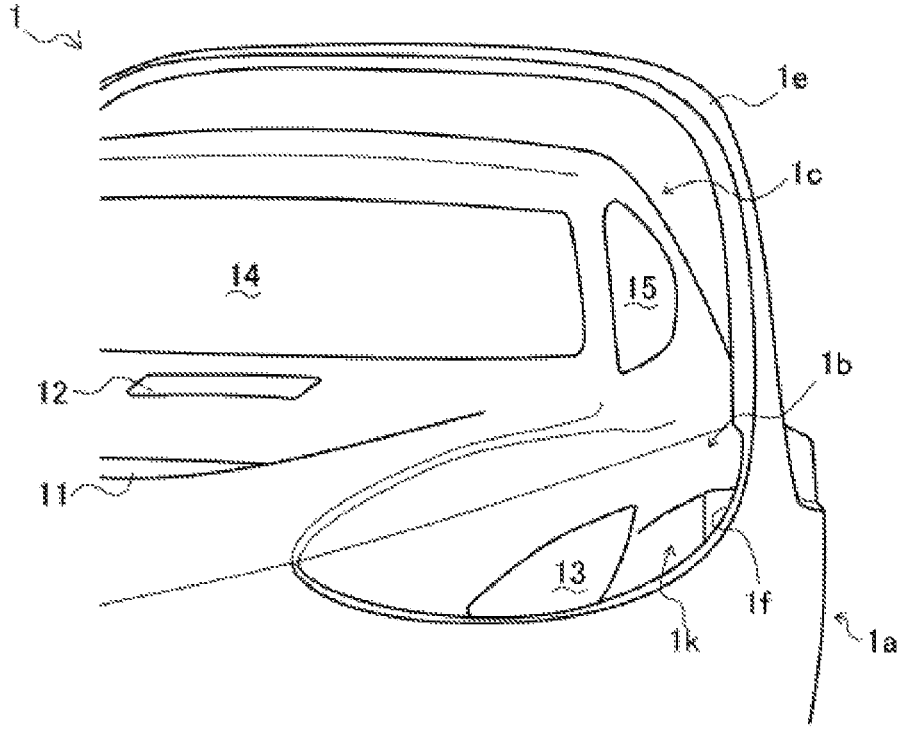
FIG. 21 is a front perspective view illustrating the air intake port of the small watercraft.
Figure 22:
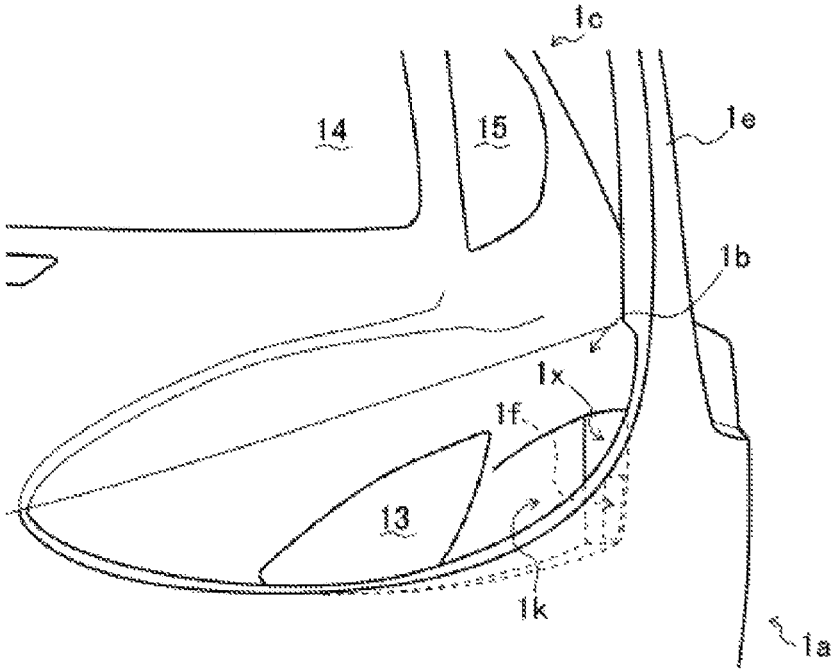
FIG. 22 is a perspective view illustrating the air intake port of the small watercraft in detail.
Figure 23:
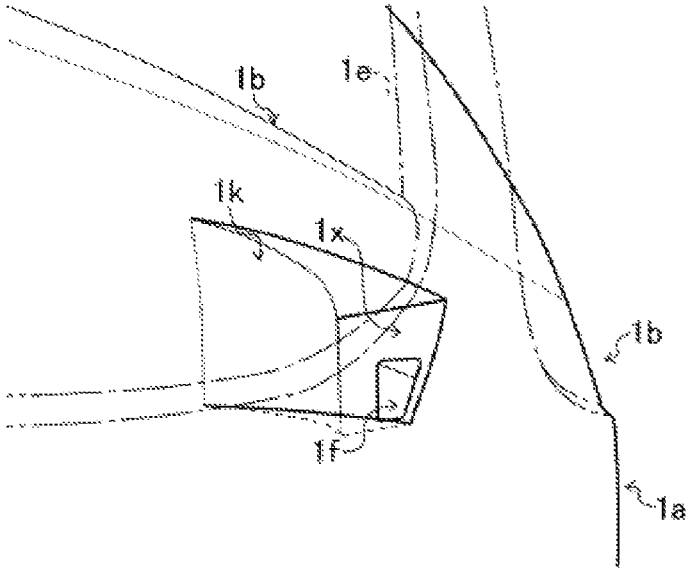
FIG. 23 is a perspective cross-sectional view illustrating the air intake port of the small watercraft in detail.
Figure 24:
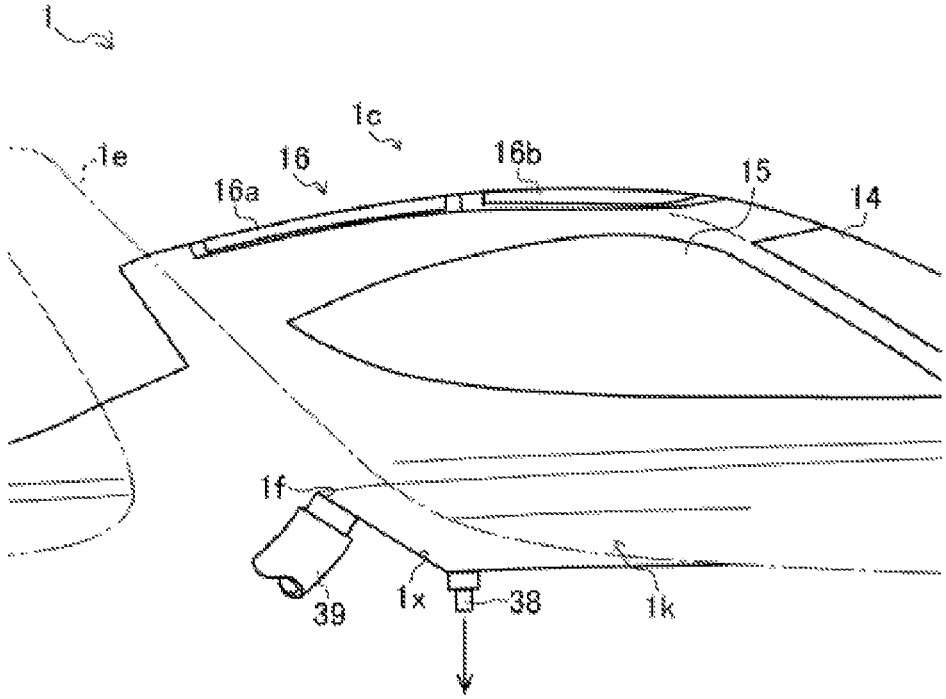
FIG. 24 is a cross-sectional side view illustrating the air intake port of the small watercraft.
Figure 25:
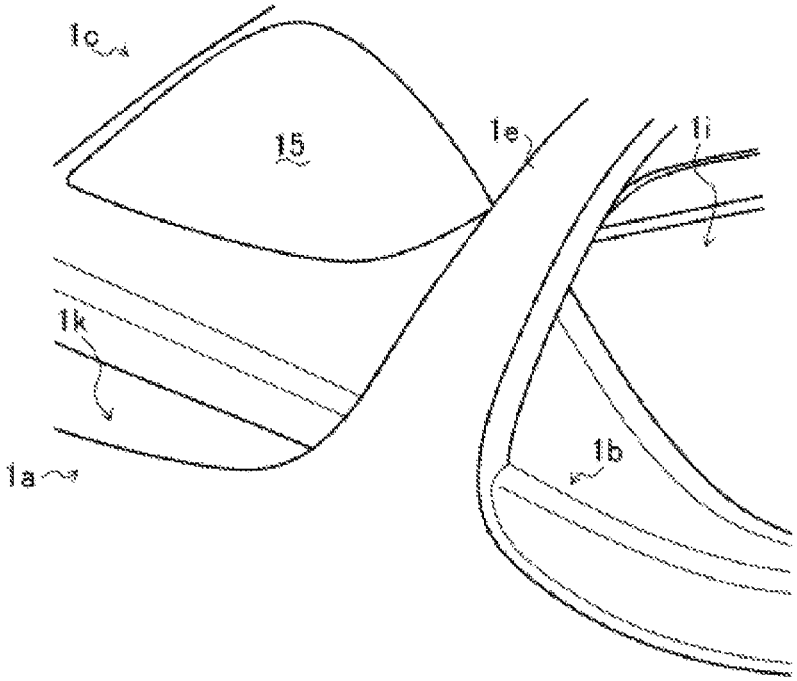
FIG. 25 is a rear perspective view illustrating the air intake port of the small watercraft.

As illustrated in FIG. 20, the air intake ports 1*f* are formed through an inclined surface 1*x* ascending from the bow toward the stern in the deck 1*b* on the inner surface of the radar arm 1*e* (surface on the deck 1*b* side) (as illustrated in FIGS. 21 to 23). Also as illustrated in FIG. 17, the air intake ports 1*f* are configured to overlap with the radar arm 1*e* when viewed from the outside of the radar arm 1*e* (in a side view of the small watercraft 1). In other words, the air intake ports 1*f* are configured not to protrude from the radar arm 1*e* when viewed from the outside of the radar arm 1*e*.

The air intake ports 1*f* are formed on the upper side of the inclined surface 1*x*. A drain outlet 38 is provided near the lower side of the inclined surface 1*x*. Thus, water entering from the bow side into the space between the deck 1*b* and the radar arm 1*e* is discharged outside through the drain outlet 38. An air introduction hose 39 is connected to each of the air intake ports 1*f*, so that air can be supplied to a gas-liquid separator 40.

Figure 26:
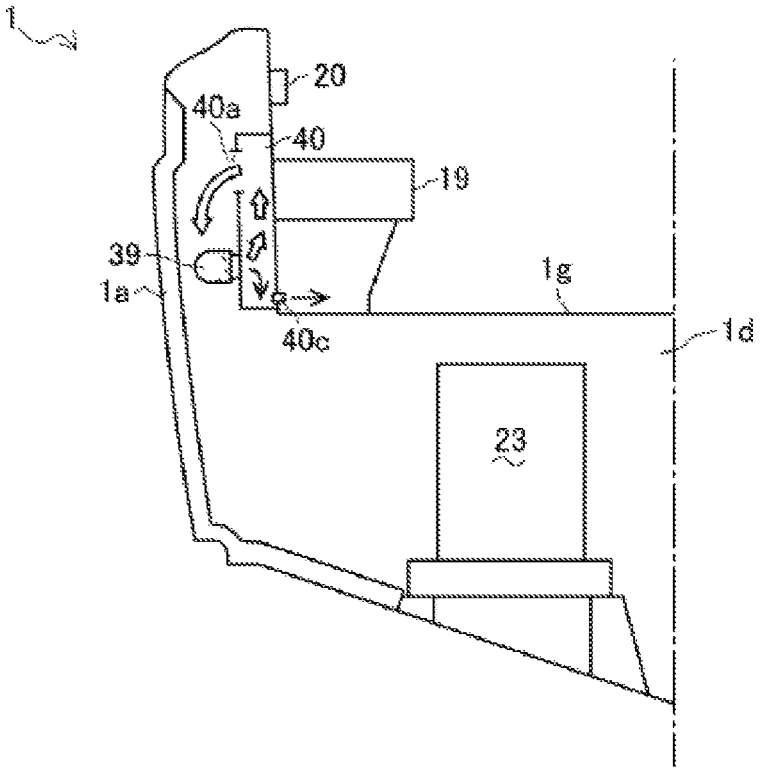
FIG. 26 is a schematic cross-sectional view, taken along the line C-C in FIG. 17, illustrating a path through which air is introduced into the engine room.
Figure 27:
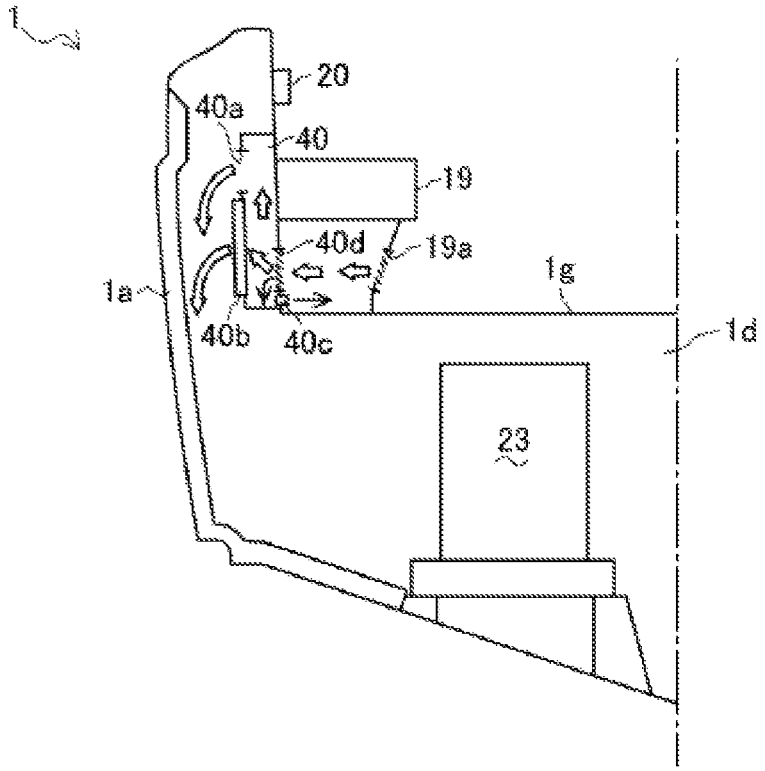
FIG. 27 is a schematic cross-sectional view, taken along the line D-D in FIG. 17, illustrating a path through which air is introduced into the engine room.

As illustrated in FIGS. 17, 26, and 27, the gas-liquid separator 40 performs separation between air, which is gas, and water, which is liquid. The gas-liquid separator 40 is disposed inside the engine room 1*d* and on an inner surface of a bulwark of the rear deck 1*g* in the hull 1*a*. The gas-liquid separator 40 has a box-like shape and has one surface defined by the inner surface of the bulwark.

As illustrated in FIG. 26, the air introduction hose 39 is connected to a side lower portion of the gas-liquid separator 40 on a bulwark opposite side. As illustrated in FIG. 27, the gas-liquid separator 40 has an air outlet 40*a* formed in a side upper portion on the bulwark opposite side, and an exhaust fan 40*b* disposed below the air outlet 40*a*. The gas-liquid separator 40 has a drain outlet 40*c* formed in a bulwark side lower portion. The gas-liquid separator 40 has an inlet 40*d* formed in a side lower portion on the bulwark side. When a seat 19 is disposed on the rear deck 1*g* to cover the inlet 40*d*, a bench support member is provided to an inlet 19*a*.

The gas-liquid separator 40 discharges water, out of air and water supplied through the air introduction hose 39 and the inlet 40*d* (the inlet 40*d* through the inlet 19*a*), through the drain outlet 40*c* (see arrows in FIG. 26), and discharges air through the air outlet 40*a* and the exhaust fan 40*b* (see outlined arrows in FIG. 26). The exhaust air is supplied to the engine 23 inside the engine room 1*d*.

In the small watercraft 1 described above, in which the air intake ports 1*f* are positioned on the inner side with respect to the radar arm 1*e*, the air intake ports 1*f* are positioned on the inner side with respect to the radar arm 1*e*, whereby water splashing from the radar arm 1*e* side (sides of the small watercraft 1) is blocked by the radar arm 1*e*. In addition, in the small watercraft 1, water that has reached a portion near the air intake ports 1*f* is drained outside through the drain outlet 38. Furthermore, in the small watercraft 1, water entering through the air intake ports 1*f* and the inlet 40*d* of the rear deck 1*g* is separated by the gas-liquid separator 40 and drained outside through the drain outlet 40*c*. Thus, the small watercraft 1 can prevent water from entering the engine room 1*d* through the air intake ports 1*f* and the inlet 40*d*.

The air intake ports 1*f* of the small watercraft 1 open toward the bow side. The air intake ports 1*f* open toward the front-outward.

As described above, in the small watercraft 1, in which the air intake ports 1*f* open toward the bow side, introduction of air through the air intake ports 1*f* is facilitated while the small watercraft 1 is moving forward. Thus, with the small watercraft 1, a larger amount of air can be introduced to the engine room 1*d* from the outside while the small watercraft 1 is moving forward.

The air intake ports 1*f* of the small watercraft 1 are positioned closer to the bow side than the engine room 1*d* is. The air intake ports 1*f* are positioned on the rear lower sides and are in communication with the air introduction hose 39.

As described above, in the small watercraft 1, in which the air intake ports 1*f* are positioned closer to the bow side than the engine room 1*d* is, air can be supplied to the engine room 1*d* without largely changing the direction in which air introduced through the air intake ports 1*f* flows while the small watercraft 1 is moving forward (with the air generally flowing from front to rear). Thus, in the small watercraft 1, air introduced through the air intake ports 1*f* can be easily supplied to the engine room 1*d* while the small watercraft 1 is moving forward.

Furthermore, in the small watercraft 1, the air intake ports 1*f* may be provided with a net-like member (mesh member) so as to prevent dust or other foreign matters from entering the inboard section through the air intake ports 1*f*.

As illustrated in FIGS. 1 to 4, or FIGS. 11, 17, 20 to 25, the small watercraft 1 has guide grooves 1*k* in a groove shape (trench shape). The guide grooves 1*k* are configured to guide air to the air intake ports 1*f*. The guide grooves 1*k* are provided to the sides of the deck 1*b*. The guide grooves 1*k* are located on the upper side of the hull 1*a*. The guide grooves 1*k* are located below the cabin 1*c*.

As described above, in the small watercraft 1, which has the guide grooves 1*k* guiding air to the air intake ports 1*f*, the air guided by the guide grooves 1*k* is introduced through the air intake ports 1*f*. Thus, in the small watercraft 1, the guide grooves 1*k* guide the air to the air intake ports 1*f*, whereby air can be easily introduced from the outside to the engine room 1*d*.

The guide grooves 1*k* of the small watercraft 1 are formed in the bow and stern direction. The guide grooves 1*k* are formed on the bow side of the respective air intake ports 1*f*. Each of the guide grooves 1*k* is formed to extend from a position closer to the bow side than the corresponding air intake port 1*f* to the air intake port 1*f*. The guide grooves 1*k* are formed to be in communication with the respective air intake ports 1*f*. The guide grooves 1*k* have a width in the left and right direction slightly increasing from the bow side toward the stern side (with the depth of the groove increasing).

As described above, in the small watercraft 1, in which the guide grooves 1*k* are formed on the bow side of the respective air intake ports 1*f*, the air guided by the guide grooves 1*k* is introduced through the air intake ports 1*f* while the small watercraft 1 is moving forward. Thus, in the small watercraft 1, the guide grooves 1*k* guide the air to the air intake ports 1*f* while the small watercraft 1 is moving forward, whereby the air can be easily introduced from the outside to the engine room 1*d* while the small watercraft 1 is moving forward.

Figure 28A:
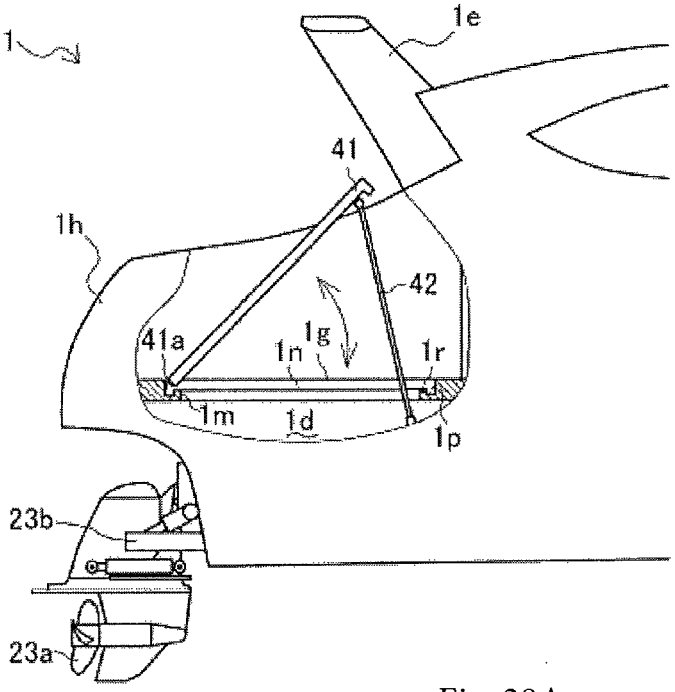
FIG. 28A is a schematic view illustrating a state where a rear deck of the small watercraft is rotated and FIG. 28B is an enlarged view illustrating another embodiment of a flap door of the rear deck of the small watercraft.

As illustrated in FIG. 28A, the rear deck 1*g* is disposed in a stern portion and on the rear side with respect to the cabin 1*c*, and thus the rear deck 1*g* is disposed on the upper side of the engine room 1*d*. An opening 1*m*, communicating with the engine room 1*d*, is formed in an approximately center portion of the rear deck 1*g*. The rear deck 1*g* is provided with a flap door 41 that can be opened and closed to close the opening 1*m*. In other words, the small watercraft 1 has the flap door 41 of the rear deck 1*g* serving as a top board of the engine room 1*d*. Thus, in the small watercraft 1, maintenance work for the engine 23 in the engine room 1*d* can be performed while the flap door 41 of the rear deck 1*g* is in the open state.

The flap door 41 can be opened and closed by raising and lowering the bow side of the flap door 41 about a hinge 41*a*, provided at an end portion on the stern side, serving as a rotational axis. The bow side end portion of the flap door 41 is connected to an electric cylinder 42 provided in the engine room 1*d*. The flap door 41 can be opened and closed through extension and contraction of the electric cylinder 42. While the flap door 41 is opened and closed by the electric cylinder 42 in the present embodiment, the present invention is not limited to this.

Figure 28B:
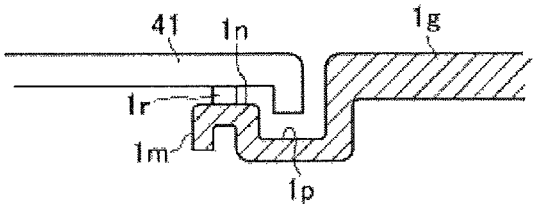
Figure 32:
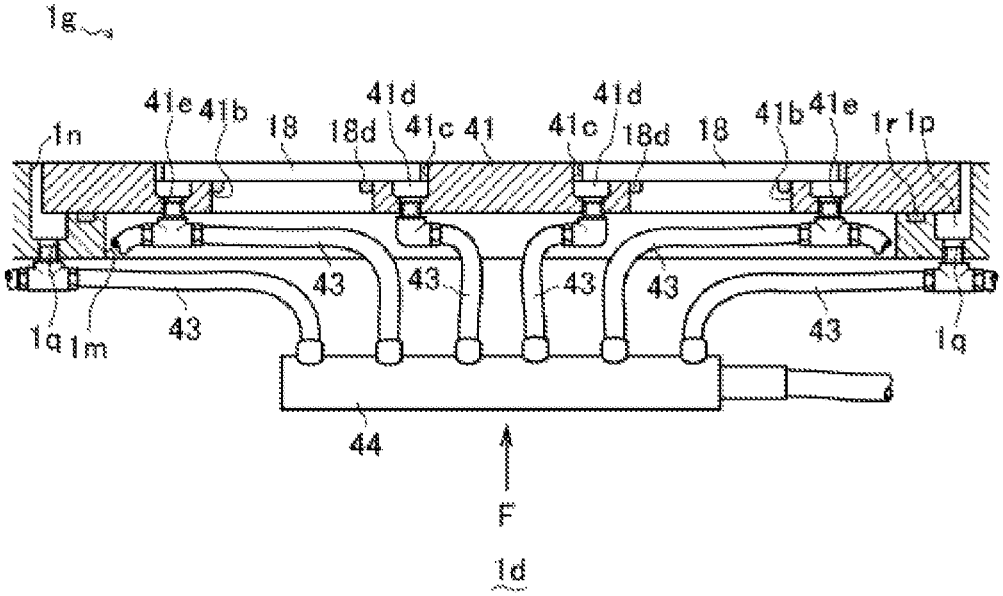
FIG. 32 is a partial cross-sectional view, taken along the along the line E-E in FIG. 29, illustrating the rear deck

As illustrated in FIGS. 28A-28B to 32, a trench 1*n* is formed at an edge portion over the entire circumference of the opening 1*m* on an upper surface of the rear deck 1*g*. In other words, the trench 1*n* is formed on the upper surface of the rear deck 1*g*, and the opening 1*m* is formed at approximately the center of the trench 1*n*. The trench 1*n* has a shape similar to the flap door 41, and a size large enough to fit the flap door 41 with a gap in between. The trench 1*n* is formed to have a depth that is approximately the same as the thickness of the flap door 41. Thus, the trench 1*n* supports the flap door 41 in such a manner that the upper surface of the rear deck 1*g* is flush with the upper surface of the flap door 41 covering the opening 1*m*.

As described above, the rear deck 1*g* has the flap door 41 fitting in the trench 1*n* so as not to have the upper surface of the flap door 41 protruding from the upper surface of the rear deck 1*g*. Thus, in the small watercraft 1, even if the rear deck 1*g* includes the flap door 41, an occupant who is walking on the rear deck 1*g* would not stumble over the flap door 41 in the closed state.

The trench 1*n* has a groove 1*p* formed on its outer edge along the entire circumference of the opening 1*m*. The groove 1*p* has drain holes 1*q* at four corners. The trench 1*n* is provided with a sealing member 1*r* on its inner edge along the entire circumference of the opening 1*m* (see FIG. 32). The sealing member 1*r* is in close contact with the lower surface of the closed flap door 41 along its entire surface. Thus, water entering the rear deck 1*g* flows in the groove 1*p* in the trench 1*n* through the gap between the rear deck 1*g* and the flap door 41, and is then discharged through the drain holes 1*q*. Here, the flap door 41 is in close contact with the sealing member 1*r* in the trench 1*n*, and thus the water is prevented from entering the engine room 1*d* through the opening 1*m*. As illustrated in FIG. 28B, the trench 1*n* and the groove 1*p* of the rear deck 1*g* may have bent end portions.

Figure 29:
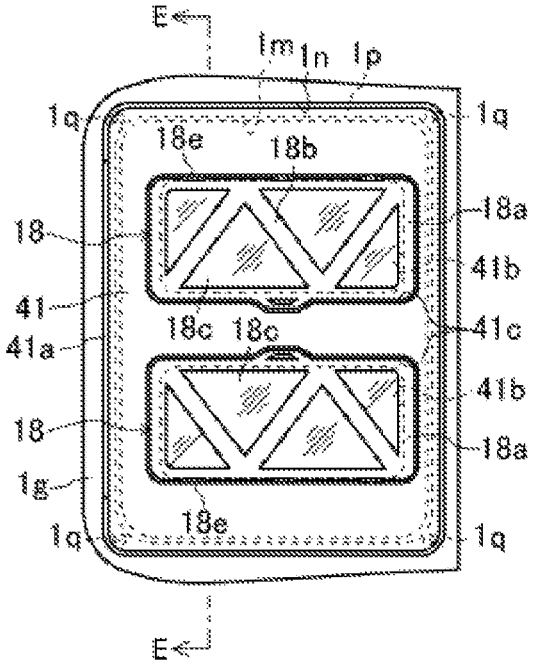
FIG. 29 is a plan view illustrating the rear deck of the small watercraft.
Figure 30:
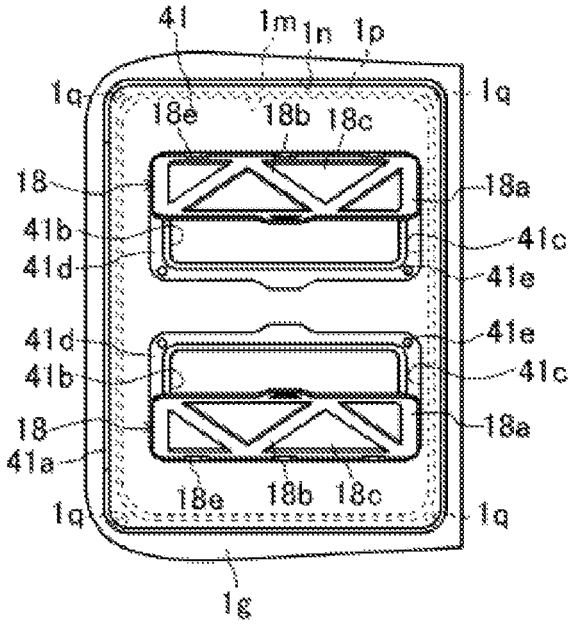
FIG. 30 is a front view of the small watercraft illustrating a state where windows are opened halfway.
Figure 31:
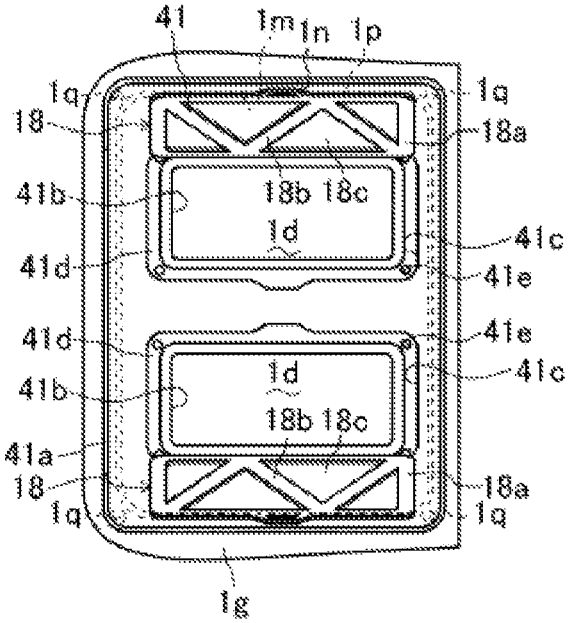
FIG. 31 is a rear view of the small watercraft illustrating a state where windows are fully opened.

As illustrated in FIGS. 29 to 31, the flap door 41 of the rear deck 1*g* has openings 41*b* in communication with the engine room 1*d* disposed on left and right sides. The flap door 41 is provided with windows 18 that can be opened and closed to cover the respective left and right openings 41*b*. In other words, in the small watercraft 1, the left and right windows 18 of the flap door 41 form a ceiling portion of the engine room 1*d*. Thus, the small watercraft 1 is configured to open the openings 41*b* by turning the windows 18 of the flap door 41 to the open state and to allow maintenance work of the engine 23 in the engine room 1*d*.

One of the windows 18 on the port side can be opened and closed by being pulled up and pushed down, by using a buried handle formed on the on the starboard side, with a hinge 18*e* formed in an end portion on the port side serving as a rotational axis. Similarly, one of the windows 18 on the starboard side can be opened and closed by being pulled up and pushed down, by using a buried handle formed on the on the starboard side, with a hinge 18*e* formed in an end portion on the port side serving as a rotational axis. In other words, the left and right windows 18 can be rotated in the left and right directions to be opened and closed in a manner similar to the double door.

The windows 18 have a frame 18*a*, a rib 18*b*, and a transparent glass plate 18*c* (tempered glass) surrounded by the frame 18*a* and the rib 18*b*. The transparent glass plate 18*c* of the rear deck 1*g* includes a transparent glass plate with no color or a colored transparent glass plate. Thus, inside of the engine room 1*d* of the small watercraft 1 can be observed from an upper part of the rear deck 1*g* (flap door 41) through the transparent glass plate 18*c* and the openings 41*b* of the window 18. Thus, in the small watercraft 1, a state of the engine 23 in the engine room 1*d* can be checked without opening the rear deck 1*g*.

As illustrated in FIGS. 28A-28B to 32, a trench 41*c* is formed on the upper surface of the flap door 41 at an edge portion of each of the left and right openings 41*b* over the entire circumference. The trench 41*c* has a shape similar to the window 18, and a size large enough to fit the window 18 with a gap in between. The trench 41*c* is formed to have a depth that is approximately the same as the thickness of the windows 18. Thus, the trench 41*c* supports the windows 18 in such a manner that the upper surface of the flap door 41 is flush with the upper surface of the windows 18 covering the openings 41*b*.

As described above, the flap door 41 has the windows 18 respectively fitting in the left and right trenches 41*c* so as not to have the upper surface of the windows 18 protruding from the upper surface of the flap door 41. Thus, in the small watercraft 1, even if the flap door 41 includes the windows 18, an occupant who is walking on the flap door 41 would not stumble over the windows 18 in the closed state.

As illustrated in FIG. 31, the left and right trenches 41*c* of the flap door 41 each have a groove 41*d* formed on its outer edge along the entire circumference of the opening 41*b*. The groove 41*d* has drain holes 41*e* at four corners. The windows 18 are each provided with a sealing member 18*d* in close contact with the inner edge along the entire circumference of the opening 41*b*. Thus, water entering the rear deck 1*g* flows not only in the gap between the rear deck 1*g* and the flap door 41, but also flows in the groove 41*d* of the trench 41*c* through the gap between the flap door 41 and the window 18, and is then discharged through the drain holes 41*e*. Here, the sealing member 18*d* of the window 18 is in close contact with the openings 41*b*, and thus the water is prevented from entering the engine room 1*d* through the opening 41*b*.

Figure 33:
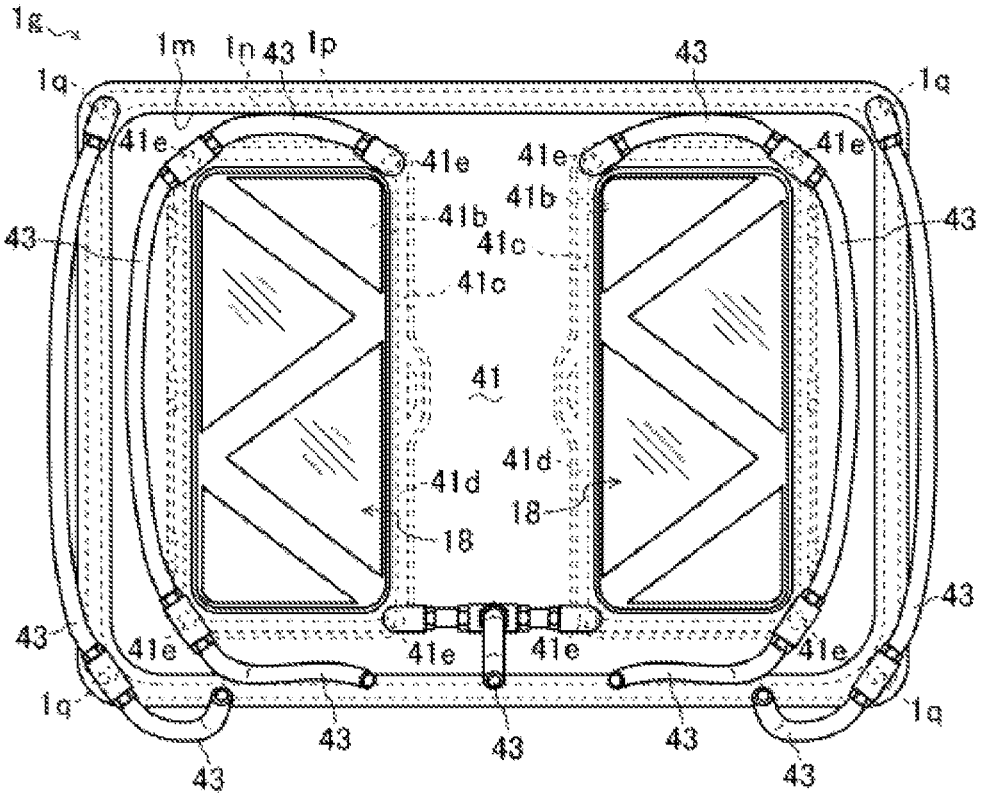
FIG. 33 is a diagram as viewed in a direction indicated by an arrow F in FIG. 32.

As illustrated in FIGS. 32 and 33, the rear deck 1*g* has the drain holes 1*q* respectively connected to drain pipes 43. More specifically, the rear deck 1*g* has the drain holes 1*q* respectively connected to the drain pipes 43 from a lower surface side. The drain pipes 43 respectively connected to the drain holes 1*q* are connected to a concentrated drain pipe 44 connected to the outside of the watercraft. Thus, the water that has entered the transom of the rear deck 1*g* can be discharged outside of the watercraft from the drain holes 1*q* through the drain pipes 43, and the concentrated drain pipe 44.

Similarly, in the flap door 41, the drain pipes 43 are respectively connected to the drain holes 41*e*. The drain pipes 43 respectively connected to the drain holes 41*e* are connected to the concentrated drain pipe 44 that is connected to the outside of the watercraft. Thus, the water that has entered the transom of the rear deck 1*g* can be discharged outside of the watercraft from the drain holes 1*q* through the drain pipes 43, and the concentrated drain pipe 44.

Figure 13:
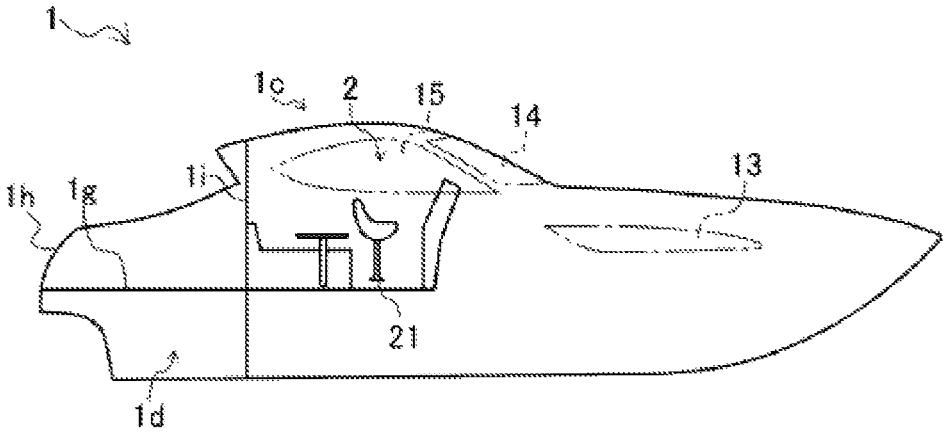
FIG. 13 is a schematic view illustrating an inner configuration of the small watercraft.

The inboard section (in the cabin 1*c*) of the small watercraft 1 can be entered through the gateway 1*i* from the rear deck 1*g*. As illustrated in FIG. 13, the small watercraft 1 includes the lounge space and the pilot house 2 as compartments to be first entered after entering the inboard section (in the cabin 1*c*) from the gateway 1*i*.

As described above, the rear deck 1*g* has the trench 1*n* in which the flap door 41 in the closed state fits. The flap door 41 has the trench 41*c* in which the window 18 in the closed state fits. Thus, even when the rear deck 1*g* of the small watercraft 1 has the flap door 41 and the windows 18, a person walking on the rear deck 1*g* would not stumble over the flap door 41 and the windows 18 in the closed state.

Figure 34:
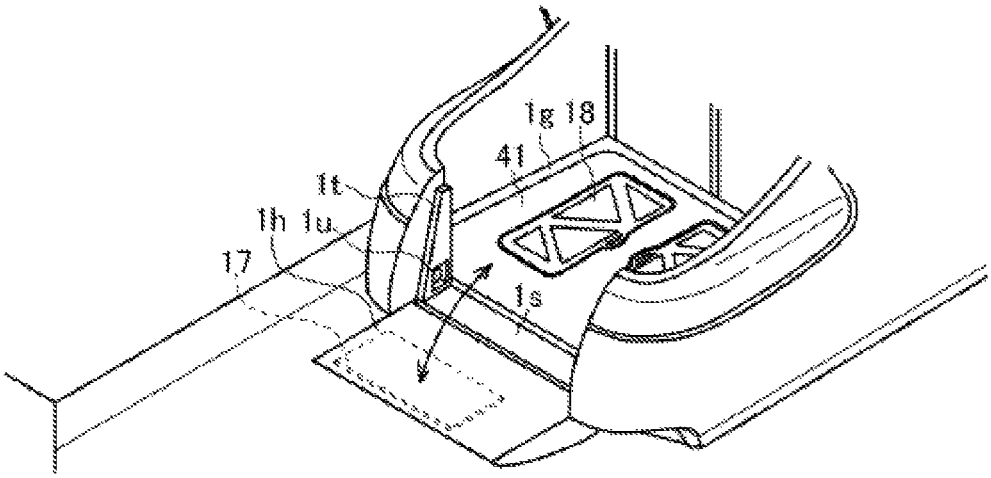
FIG. 34 is a perspective view illustrating a state where a transom gate of the small watercraft is open.
Figure 35:
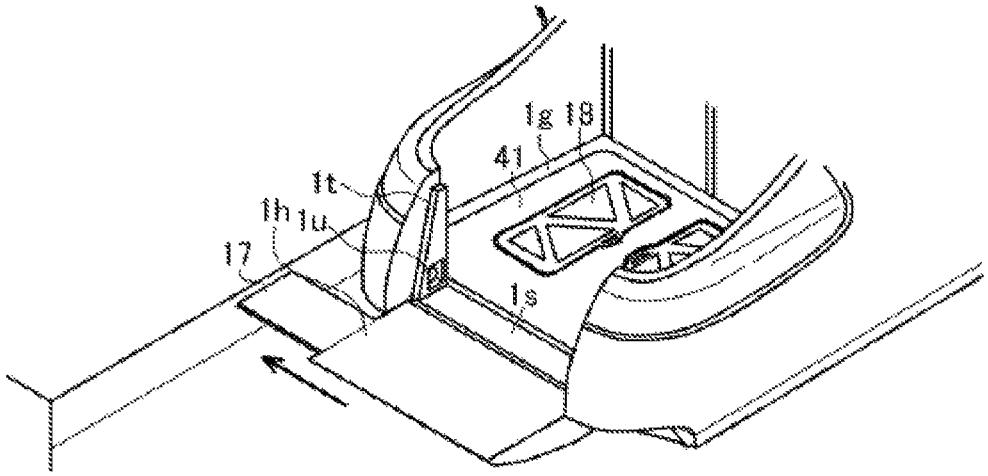
FIG. 35 is a perspective view of the small watercraft illustrating a state where an extension portion extends in one direction.
Figure 36:
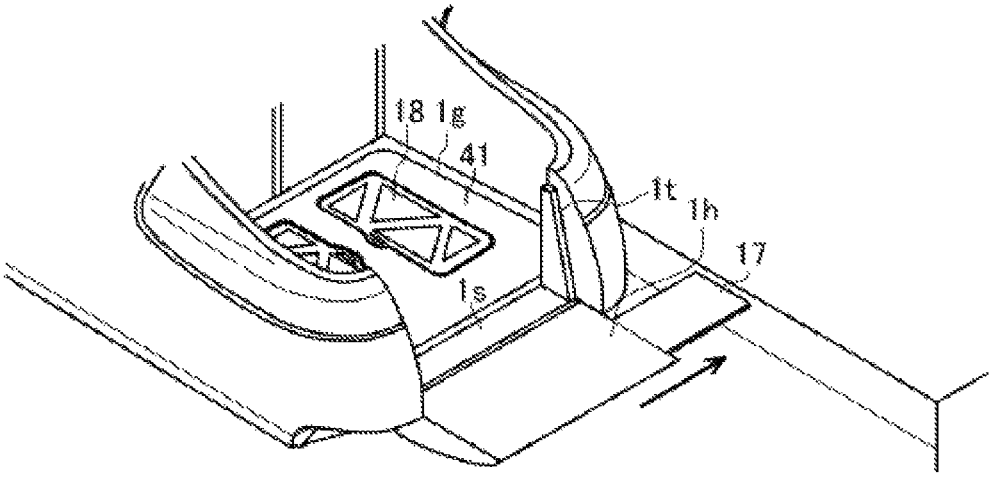
FIG. 36 is a perspective view of the small watercraft illustrating a state where the extension portion extends in another direction.

As illustrated in FIGS. 34 to 36, the transom gate 1*h* of the small watercraft 1 is used as a path to move from the small watercraft 1 to a land (for example, a pier). The transom gate 1*h* is disposed in the stern side rear end portion. The transom gate 1*h* is formed as a part of a transom surrounding the rear deck 1*g*. The transom gate 1*h* is rotatable about a lower end portion as rotational center. The transom gate 1*h* in the closed state has an inclined surface oriented toward the stern on a lower side of a side surface on a side of the rear deck 1*g*. In other words, the transom gate 1*h* has a side surface on the side of the rear deck 1*g* further recessed than the side surface of the transom. Thus, the rear deck 1*g* has a step portion is fixed between the side surface of the transom gate 1*h* in the closed state on the side of the rear deck 1*g* and the flap door 41.

The transom gate 1*h* in the closed state has the side surface on the side of the rear deck 1*g* in contact with a reception portion 1*t* provided to the transom. The reception portion 1*t* protrudes from side surface of the transom facing the left and the right side surfaces of the transom gate 1*h* by a predetermined width. The reception portion 1*t* comes into contact with the side surface of the transom gate 1*h* in the closed state on the side of the rear deck 1*g*. The reception portion 1*t* has a partial recess that is formed in the side surface and incorporates a socket 1*u* for an external utility.

The transom gate 1*h* of the small watercraft 1 includes the extension portion 17 that is a flat plate member. The extension portion 17 of the transom gate 1*h* can be accommodated within the transom gate 1*h* or can extend (pulled out) to the outer side from the transom gate 1*h*. The extension portion 17 of the transom gate 1*h* is slid into the transom gate 1*h* to be accommodated when the transom gate 1*h* is closed. The extension portion 17 of the transom gate 1*h* can slide to be extended to the outer side from the transom gate 1*h* that has been rotated to be laid rearward. The extension portion 17 of the transom gate 1*h* can be extended in a direction toward a side surface of the small watercraft 1 (in the width direction of the small watercraft 1) from the transom gate 1*h* that has been rotated to be laid rearward. The extension portion 17 of the transom gate 1*h* can be extended to an end of the hull 1*a* in the width direction (an end portion at a portion where the width of the hull 1*a* is the largest). The extension portion 17 of the transom gate 1*h* can extend toward the left or the right.

As described above, in the small watercraft 1 having the transom gate 1*h* including the extension portion 17 that can be extended outward from the transom gate 1*h* that has been rotated and laid rearward, the extension portion 17 of the transom gate 1*h* can be extended from the transom gate 1*h* that has been rotated and laid rearward. Thus, for example, the small watercraft 1 has the transom gate 1*h* rotated to be laid rearward and the extension portion 17 extended when a person moves from the small watercraft 1 to a land (for example, a pier). Thus, the person can more easily move from the small watercraft 1 to the land compared with a configuration in which the transom gate 1*h* includes no extension portion 17.

Figure 37:
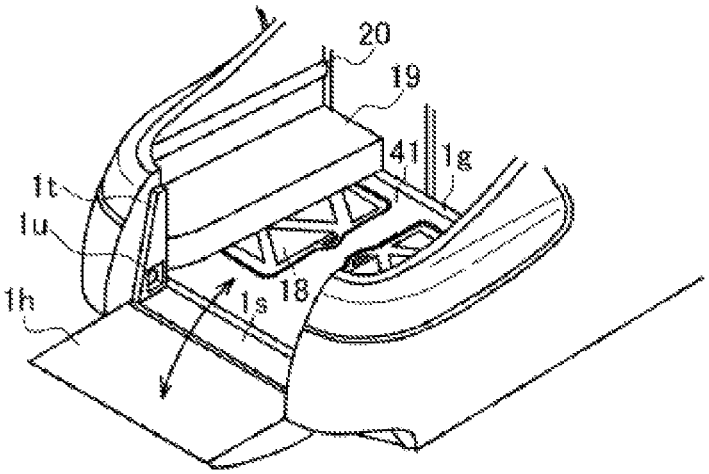
FIG. 37 is a perspective view of the small watercraft illustrating a state where a sheet is attached to the rear deck.

As illustrated in FIG. 37, the small watercraft 1 may include a seat 19 and a backrest 20 in the stern portion. The seat 19 in the small watercraft 1 is detachably attached to the rear deck 1*g* and the backrest 20 is detachably attached to an inner wall of the transom.

INDUSTRIAL APPLICABILITY

The present invention can be applied to a technique for a small watercraft.

REFERENCE SIGNS LIST

1 small watercraft
1*a* hull
1*b* deck
1*c* cabin
1*d* engine room
1*e* radar arm
1*f* air intake port
1*g* rear deck
1*h* transom gate
1*k* guide groove
17 extension portion
18 window

The invention claimed is:

1. A watercraft for leisure use, the watercraft being configured to obtain thrust by driving a propeller with an engine serving as a power source, the watercraft comprising:

an air intake port configured to introduce air into an engine room in an inboard section from outside; and a radar arm configured to support a radar, wherein the air intake port is positioned on an inner side with respect to a bottom part of the radar arm, so as to overlap with the radar arm when viewed from the outside of the radar arm and configured to open toward a bow side.

2. The watercraft according to claim 1, further comprising a guide groove configured to guide the air to the air intake port.

3. The watercraft according to claim 1, wherein the guide groove is disposed on a bow side of the air intake port.

4. The watercraft according to claim 2, wherein the guide groove is disposed on a bow side of the air intake port.

5. The watercraft according to claim 1, further comprising:

a transom gate, wherein the transom gate includes an extension portion that extends outward from the transom gate with the transom gate rotated and laid rearward.

6. The watercraft according to claim 2, further comprising:

a transom gate, wherein the transom gate includes an extension portion that extends outward from the transom gate with the transom gate rotated and laid rearward.

7. The watercraft according to claim 3, further comprising:

a transom gate, wherein the transom gate includes an extension portion that extends outward from the transom gate with the transom gate rotated and laid rearward.

8. The watercraft according to claim 4, further comprising:

a transom gate, wherein the transom gate includes an extension portion that extends outward from the transom gate with the transom gate rotated and laid rearward.

* * * * *